US010320110B2

(12) United States Patent
Loetkemann et al.

(10) Patent No.: US 10,320,110 B2
(45) Date of Patent: Jun. 11, 2019

(54) PLUG-IN CONNECTOR

(71) Applicant: HARTING ELECTRIC GMBH & CO. KG, Espelkamp (DE)

(72) Inventors: Irina Loetkemann, Espelkamp (DE); Dieter Riepe, Luebbecke (DE); Heiko Meier, Minden (DE); Jens Grunwald, Buecken (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/743,993

(22) PCT Filed: Aug. 18, 2016

(86) PCT No.: PCT/DE2016/100373
§ 371 (c)(1),
(2) Date: Jan. 11, 2018

(87) PCT Pub. No.: WO2017/028844
PCT Pub. Date: Feb. 23, 2017

(65) Prior Publication Data

US 2018/0241147 A1 Aug. 23, 2018

(30) Foreign Application Priority Data

Aug. 20, 2015 (DE) ..... 10 2015 113 786

(51) Int. Cl.
*H01R 13/50* (2006.01)
*H01R 13/506* (2006.01)
(Continued)

(52) U.S. Cl.
CPC ..... *H01R 13/506* (2013.01); *H01R 13/42* (2013.01); *H01R 13/516* (2013.01); *H01R 31/06* (2013.01); *H01R 2101/00* (2013.01)

(58) Field of Classification Search
CPC ..... H01R 13/506; H01R 13/42; H01R 13/516
(Continued)

(56) References Cited

U.S. PATENT DOCUMENTS 2,813,144 A * 11/1957 Valach ..... H01R 24/545 174/87
3,432,798 A * 3/1969 Brishka ..... 439/322
(Continued)

FOREIGN PATENT DOCUMENTS

DE 19508605 7/1996 ..... H01R 13/629
DE 19805708 9/1999 ..... H01R 13/52
(Continued)

OTHER PUBLICATIONS

German Office Action (w/machine translation) issued in application No. 10 2015 113 786.0, dated Jul. 14, 2016 (7 pgs).
(Continued)

*Primary Examiner* — Alexander Gilman
(74) *Attorney, Agent, or Firm* — Hayes Soloway P.C.

(57) ABSTRACT

A plug-in connector has a plug-in connector housing, an insulating body and a contact. The plug-in connector is rectangular and is designed to be mounted on a device wall or on another surface. The contact of the plug-in connector is also rectangular and in the form of a single piece. A two-part insulating body which is placed in the plug-in connector housing from two directions is necessary for assembling the plug-in connector.

14 Claims, 3 Drawing Sheets

(51) Int. Cl.
*H01R 13/42* (2006.01)
*H01R 13/516* (2006.01)
*H01R 31/06* (2006.01)
*H01R 101/00* (2006.01)

(58) Field of Classification Search
USPC ..... 439/660
See application file for complete search history.

(56) References Cited

U.S. PATENT DOCUMENTS 3,528,052 A * 9/1970 Brishka ..... 333/260
5,658,162 A * 8/1997 Harting ..... H01R 13/62966 439/157
6,126,482 A * 10/2000 Stabile ..... H01R 24/545 439/578
7,273,394 B1 * 9/2007 English ..... H01R 24/545 439/582
7,413,478 B2 8/2008 Kleinschmidt et al. ..... 439/686
7,419,391 B2 * 9/2008 Schmidt ..... H01R 13/447 439/157
7,465,185 B2 * 12/2008 Tyler ..... H01R 13/506 439/352
7,717,723 B2 * 5/2010 Nehm ..... H01R 13/62966 439/157
7,785,131 B2 * 8/2010 Ferderer ..... H01R 13/62933 439/157
8,016,604 B2 * 9/2011 Matsumoto ..... B60L 3/0069 439/304
8,641,447 B2 * 2/2014 Sykes ..... H01R 24/44 439/582
8,956,186 B2 2/2015 de Chazal ..... 439/607.27
8,979,568 B2 * 3/2015 Herbrechtsmeier ..... H01R 13/62966 439/346
8,992,250 B1 * 3/2015 Hosler, Sr. ..... H01R 13/622 439/322
9,166,329 B2 10/2015 Eckel et al.
2006/0084286 A1 * 4/2006 Kooiman ..... H01R 24/52 439/63
2007/0082510 A1 * 4/2007 Henningsen ..... H01R 24/545 439/63
2010/0304608 A1 * 12/2010 Clausen ..... H01R 24/545 439/582
2011/0021070 A1 * 1/2011 Burris ..... H01R 13/502 439/578

FOREIGN PATENT DOCUMENTS

DE 202006003204 5/2006 ..... H01R 13/648
DE 102011004347 8/2012 ..... H01R 13/52
DE 112014001338 11/2015 ..... H01R 13/502

OTHER PUBLICATIONS

International Preliminary Report on Patentability issued in application No. PCT/DE2016/100373, dated Mar. 1, 2018 (10 pgs).
International Search Report and Written Opinion (w/translation) issued in application No. PCT/DE2016/100373, dated Dec. 6, 2016 (27 pgs).

* cited by examiner

PLUG-IN CONNECTOR

BACKGROUND OF THE INVENTION

The invention relates to a plug connector for reversibly connecting electrical lines or connections to one another. Plug connectors and mating plug connectors are used in the prior art to produce an electrical and mechanical connection between two electrical lines or an electrical line and a device or an installation. In particular for transmitting high currents, plug connectors are required which are protected against environmental influences by the housing.

DESCRIPTION OF THE PRIOR ART

DE 20 2006 003 204 U1 discloses a plug connector which is formed as a plug or an attachment housing. The plug connector comprises a plug connector housing in which an insulating body with electrical contacts is received. The electrical contacts are provided for the connection of electrical lines which lead out of the plug or attachment housing on the rear side of the plug connector.

The known solutions for plug connectors are disadvantageous in that the size of the plug connector is influenced by the design and connectivity. In the plug connectors known from the prior art, electrical lines or cables are connected to the electrical contacts in most cases. The connection region for these lines or cables takes up a lot of space, which has to be provided in the plug connector since the connection region is received in the plug connector. The overall size of the plug connector is thus increased.

Plug connectors which have a very flat structure are especially required in the region of device connections. Very tall plug connectors provide many opportunities for faults resulting from undesired mechanical effects. Moreover, the connection of cables and lines to contacts in the plug connector is difficult when the plug connector is formed as an attachment housing and little space is provided on the device side for guiding the cables and lines.

OBJECT OF THE INVENTION

The object of the invention consists in forming a plug connector in such a way that the required installation and assembly space is as small as possible. The aim here is to enable the assembly of the plug connector to be as simple as possible and at the same time to reduce the connection space for cables and lines outside the plug connector.

SUMMARY OF THE INVENTION

The invention relates to a plug connector which at least has a plug connector housing, an insulating body and an electrical contact. The insulating body is received in the plug connector housing and the electrical contact is received in the insulating body. On one side, the plug connector forms a plug side which is provided for contacting a mating plug connector. On a further side, the plug connector forms an assembly side which is provided to fasten the plug connector to a surface of a housing or a device.

The plug side of the plug connector is formed such that the electrical contact in the plug connector is arranged in the plug side and can contact a mating plug connector. A locking means is arranged on the outside of the plug side, which locking means can lock the plug connector mechanically to a contacted mating plug connector. The locking means is preferably constructed as a locking clip, but can also be designed in other ways known from the prior art.

The assembly side of the plug connector preferably has an assembly means which enables the plug connector to be fastened to a surface. The assembly means is preferably constructed as an assembly flange having at least one bore. A screw can therefore be guided through the bore, for example, and the plug connecter can be tightly screwed to a surface. A preferred embodiment provides for at least two bores to be arranged in the fastening flange to ensure reliable fastening. According to the invention, the electrical contact is arranged in the assembly side of the plug connector such that it can contact a mating contact directly.

According to the invention, the electrical contact is formed such that it forms two contact sides. A first contact side, which is arranged in the plug side of the plug connector, and a second contact side, which is arranged in the assembly side of the plug connector. This form of the electrical contact makes it particularly advantageously possible for the plug connector to be contacted directly by mating contacts on two sides. The connection of a cable or line is unnecessary. The respective contact sides of the electrical contact can be formed here as socket or pin contacts. The contact can therefore have two similar or two different contact sides.

In a preferred embodiment, the two contact sides of the electrical contact are constructed identically. A particularly preferred embodiment provides for the two contacts sides to be formed as pin contacts. The contact can thus be produced favorably and easily.

In an advantageous embodiment, the plug side and the assembly side of the plug connector are provided on two adjacently arranged sides of the plug connector. The plug and assembly side are therefore preferably arranged at an angle of approximately 90 degrees with respect to one another. This arrangement enables a particularly space-saving assembly of the plug connector on a device or a surface.

In a preferred embodiment, the insulating body of the plug connector is designed in two parts, comprising a first insulating body part and a second insulating body part. The first insulating body part here is that which is arranged on the plug side in the plug connector housing and the second insulating body part is that which is arranged on the assembly side in the plug connector housing. The two insulating body parts are provided to be mechanically latched to one another. They have latching means for this purpose, which enable the insulating body parts to be latched to another through being joined together.

In a particularly advantageous embodiment of the invention, the first insulating body part can be inserted into the plug connector housing via the plug side. The second insulating body part, on the other hand, can be inserted into the plug connector housing via the assembly side. The insulating body parts can thus be inserted into the plug connector housing from two directions. At the same time, it is thus possible for the first insulating body part to latch to the second insulating body part in the plug connector housing when both are inserted into this.

The electrical contact is expediently received and mechanically held in one of the two insulating body parts. The electrical contact can thus be inserted into one of the two parts before they are pushed into the plug connector housing and latched to one another therein. An advantageous embodiment provides for one part of the two insulating body parts to in turn be designed in two parts. The electrical contact can thus be received and held in the insulating body part in an improved manner.

A particularly preferred embodiment provides for the electrical contact to be rectangular in form so that the first contact side is arranged at an angle of approximately 90 degrees with respect to the second contact side. The insulating body is formed likewise. One of the insulating body parts can thus be inserted into one of the sides of the plug connector housing with the electrical contact received in said insulating body part. As a result of the rectangular construction of the plug connector housing, electrical contact and insulating body, one of the insulating body parts has to be guided into the plug connector housing by means of a rotational movement. After its insertion, the other insulating body part can be inserted into the plug connector housing via the second side and connected to the first insulating body part.

BRIEF DESCRIPTION OF THE DRAWINGS

An exemplary embodiment of the invention is illustrated in the drawings and will be explained in more detail below. The drawings show.

The figures contain partially simplified schematic illustrations. Identical reference numerals are sometimes used for elements which are similar but possibly not identical. Different views of similar elements could be drawn to different scales.

DETAILED DESCRIPTION OF THE INVENTION

Figure 1:
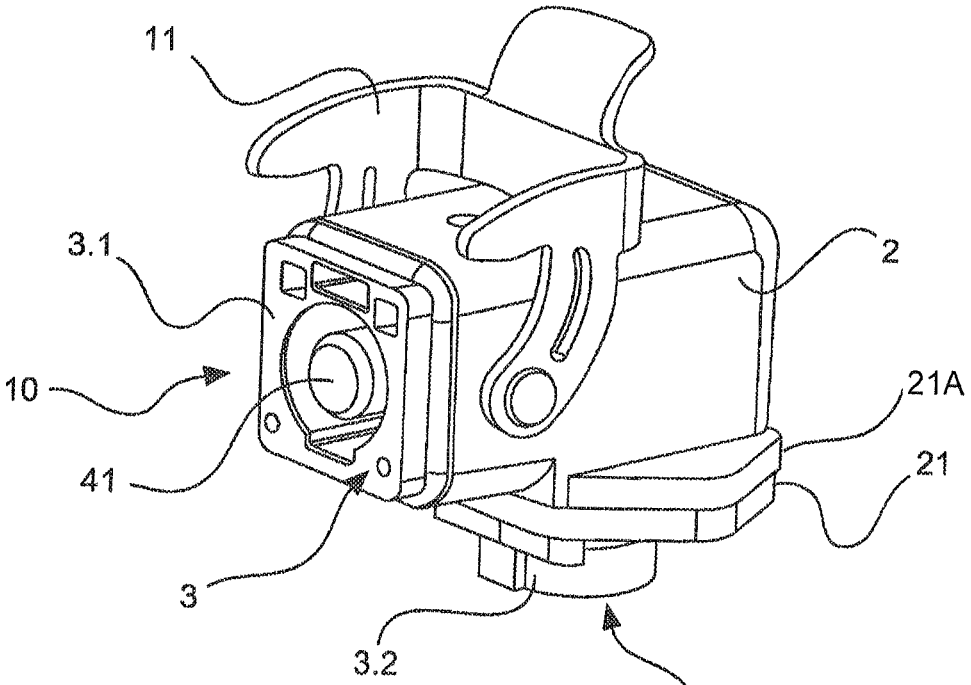
FIG. 1 a perspective illustration of a plug connector according to the invention.

FIG. 1 shows a plug connector 1 according to the invention in a perspective illustration. The plug connector 1 is formed by a plug connector housing 2. The plug connector housing 2 is rectangular in form and forms a plug side 10 and an assembly side 20 arranged at approximately 90 degrees.

The plug side 10 is fitted with a locking means 11. The locking means 11 formed as a locking clip is arranged around the plug side 10 and serves for locking the plug connector 1 to a contacted mating plug connector.

The assembly side 20 of the plug connector 1 is fitted with an assembly means 21. The assembly means 21 here is formed as a fastening flange 21A which is provided on two opposite sides of the plug connector housing 2. Two bores (only one is visible here) are provided in the fastening flange, which bores serve for fastening the plug connector 1 by means of two screws.

The insulating body 3 is arranged in the plug connector housing 2. The insulating body 3 here is formed in two parts from a first insulating body part 3.1 and a second insulating body part 3.2. The first insulating body part 3.1 here is inserted into the plug side 10 of the plug connector 1. The second insulating body part 3.2 is inserted into the assembly side 20 of the plug connector 1. According to the invention, the two insulating body parts 3.1, 3.2 are latched to one another in the plug connector housing 2 and thus mechanically connected. An electrical contact 4 is received in the insulating body 3, which electrical contact forms a first contact side 41 in the plug side 10 of the connector 1.

Figure 2:
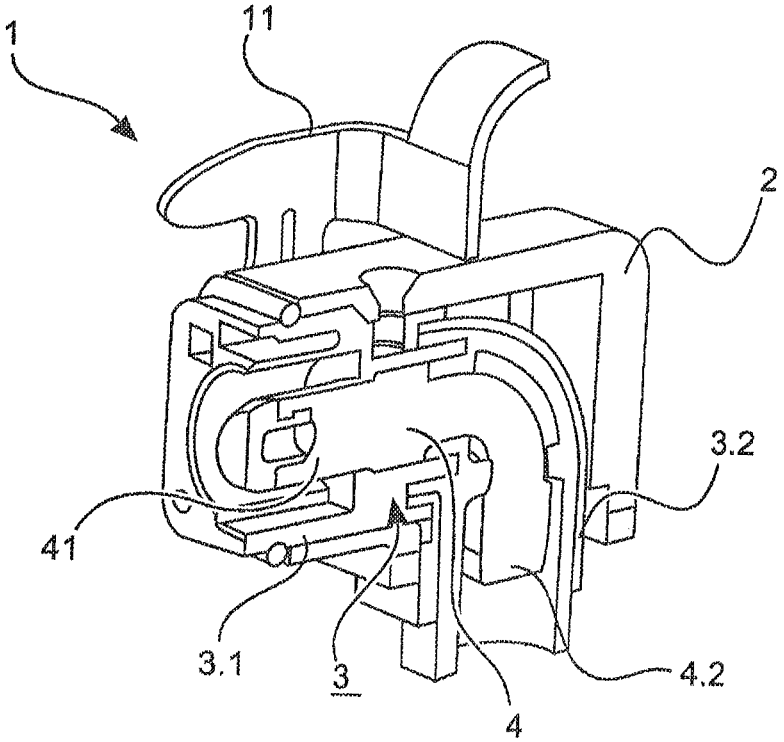
FIG. 2 a perspective sectional illustration of a plug connector according to the invention.

The plug connector 1 of FIG. 1 is shown in FIG. 2, but in a sectional illustration. In addition to the components of the plug connector 1 which can already be seen in FIG. 1, the insulating body 3 and the electrical contact 4 can be seen in detail in FIG. 2. The electrical contact 4, bent at a right angle, forms a first contact side 41 and a second contact side 42. The first contact side 41 is arranged in the plug side 10 of the plug connector 1 here. The second contact side 42 is arranged in the assembly side 20 of the plug connector 1. Both the first contact side 41 and the second contact side 42 project out of the plug connector housing 2 here, at least in some regions.

The insulating body 3 is formed from a first insulating body part 3.1 and a second insulating body part 3.2. The second insulating body part 3.2 here surrounds the assembly-side second contact side 42 of the electrical contact 4. The first insulating body part 3.1 surrounds the plug-side first contact side 41 of the electrical contact 4. The two insulating body parts 3.1 and 3.2 are latched to one another within the plug connector housing 2.

Figure 3:
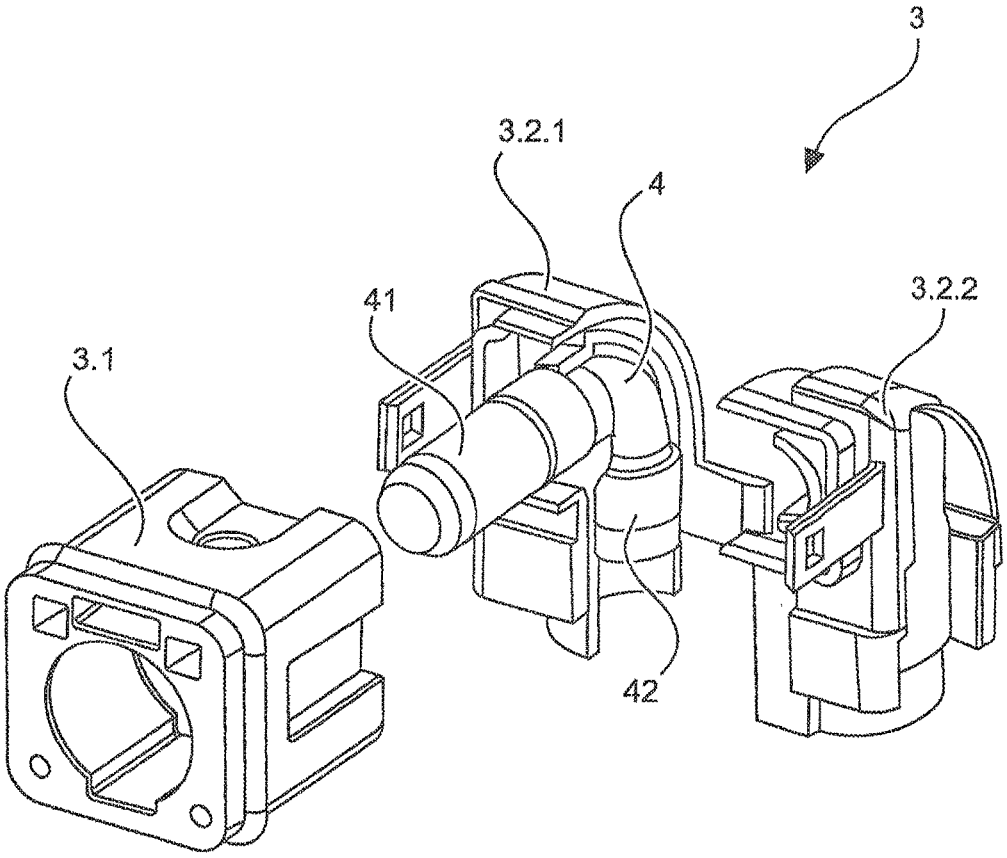
FIG. 3 an exploded illustration of an insulating body with the electrical contact.

An isolated insulating body 3 is illustrated with an inserted electrical contact 4 in an exploded view in FIG. 3. In the specific embodiment shown, the second insulating body part 3.2 is in turn designed in two parts. It comprises a first insulating body part half-shell 3.2.1 and a second insulating body half-shell 3.2.2. As a result of the two-part insulating body part 3.2, the electrical contact 4 can be received and held in the insulating body 3 in an improved manner.

The first insulating body part 3.1 is arranged in the front, plug-side region and can be latched to the second insulating body part 3.2.

As a result of the rectangular form of the plug connector housing 2, the contact 4 and the insulating body 3, the assembly of the plug connector 1 differs according to the invention from the other plug connector. The assembly is therefore illustrated in FIGS. 4 and 5.

Figure 4:
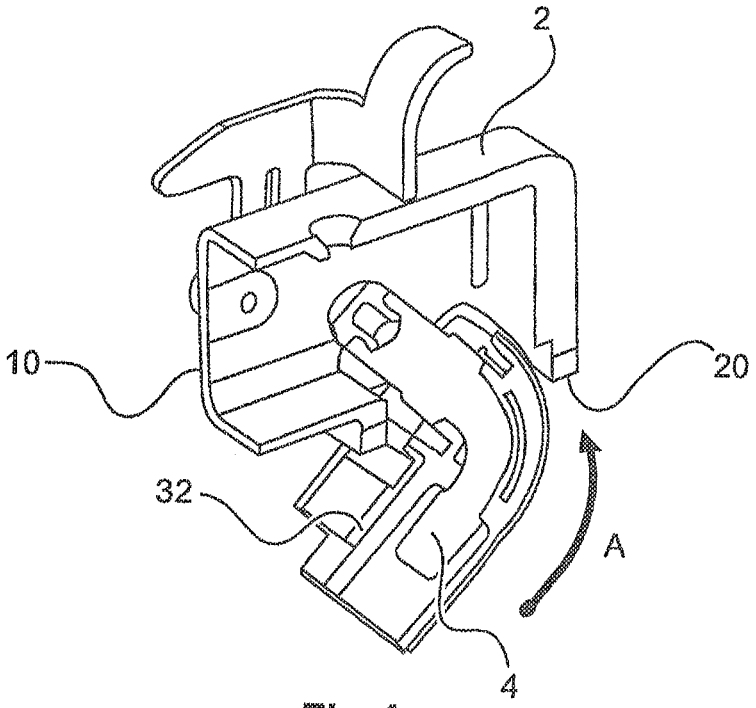
FIG. 4 a perspective sectional illustration of a first assembly step of a plug connector according to the invention.

The assembly of the plug connector 1 requires the contact 4 to be inserted into the second insulating body part 3.2 as already illustrated in FIG. 3. FIG. 4 furthermore shows a first assembly step. In this, the second insulating body part 3.2 having the inserted contact 4 is positioned on the assembly side 20 of the plug connector housing 2. The alignment of the insulating body part 3.2 is rotated through approximately 45 degrees with respect to the end position in the plug connector housing 2.

Figure 5:
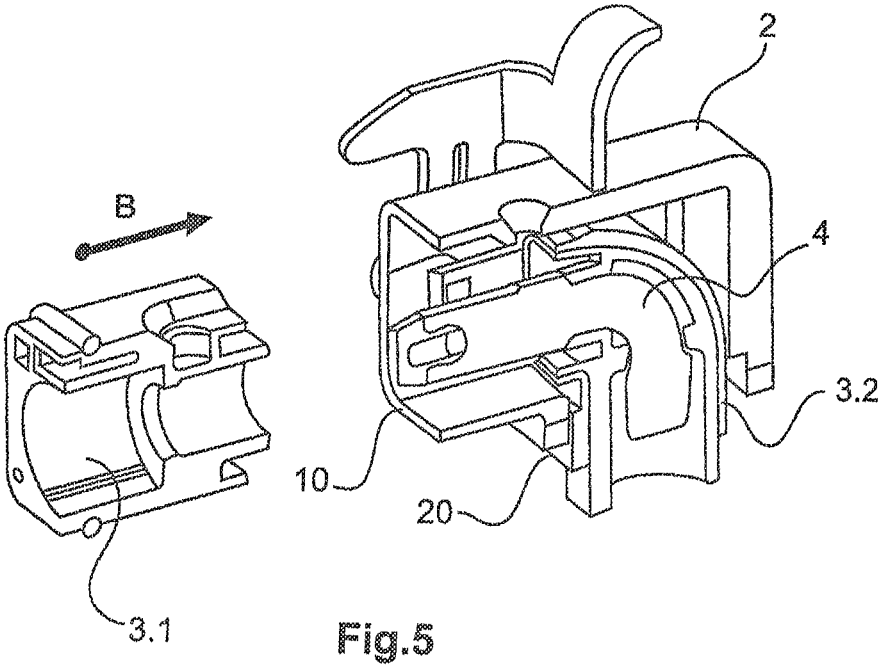
FIG. 5 a perspective sectional illustration of a second assembly step of a plug connector according to the invention.

As a result of a rotational movement in the movement direction A, the insulating body part 3.2 is inserted into the plug connector housing 2 until it has reached a final position (see FIG. 5). The second assembly step shown in FIG. 5 shows the insertion of the first insulating body part 3.1. This is inserted into the plug side 10 of the plug connector housing 2 in the movement direction B. With this, the first insulating body part 3.1 latches in its end position to the second insulating body part 3.2. The fully assembled plug connector corresponds to FIG. 2.

The invention claimed is:

1. A plug connector, which has a plug connector housing, an insulating body arranged in the plug connector housing and an electrical contact arranged in the insulating body, wherein the plug connector forms a plug side and an assembly side, wherein the plug side and the assembly side are arranged at an angle of approximately 90 degrees with respect to one another, wherein the electrical contact is bent at a right angle and forms a first contact side in the plug side of the plug connector and a second contact side in the assembly side of the plug connector, and is rotatably mounted within the plug connector housing, wherein the first contact side and the second contact side project out of the plug connector housing, at least in some regions, wherein the assembly side has a fastening flange provided on opposite sides of the plug connector housing for assembling the plug connector, and wherein the plug side has at least one lock for locking the plug connector to a mating plug connector.

2. The plug connector as claimed in claim 1, wherein the first contact side is formed as a contact socket or contact pin and the second contact side is formed as a contact socket or contact pin.

3. The plug connector as claimed in claim 2, wherein the first contact side and the second contact side are formed in a similar manner.

4. The plug connector as claimed in claim 1, wherein the plug side and the assembly side are formed on two adjacent adjoining sides of the plug connector housing.

5. The plug connector as claimed in claim 1, wherein the insulating body comprises at least two parts, a plug-side first insulating body part and an assembly-side second insulating body part.

6. The plug connector as claimed in claim 5, wherein the first insulating body part and the second insulating body part are adapted to be latched to one another.

7. The plug connector as claimed in claim 6, wherein the electrical contact is held mechanically in an insulting body part.

8. The plug connector as claimed in claim 5, wherein the electrical contact is held mechanically in an insulating body part.

9. The plug connector as claimed in claim 5, wherein at least one of the insulating body parts is formed in two parts.

10. The plug connector as claimed in claim 5, wherein the first insulating body part is adapted to be inserted into the plug connector housing through the plug side thereof and the second insulating body part is adapted to be inserted into the plug connector housing via the assembly side thereof.

11. The plug connector as claimed in claim 10, wherein the first insulating body part and the second insulating body part are adapted to be latched to one another.

12. The plug connector as claimed in claim 10, wherein the electrical contact is held mechanically in an insulting body part.

13. The plug connector as claimed in claim 1, wherein the assembly is an assembly flange having at least one fastening bore.

14. A method for assembling a plug connector, wherein the plug connector has a plug connector housing, an insulating body and an electrical contact, wherein the insulating body is formed from at least one first insulating body part and one second insulating body part, wherein the plug connector forms a plug side and an assembly side, wherein the assembly side has a fastening flange provided on opposite sides of the connector for assembling the plug connector, wherein the plug side and the assembly side are arranged at an angle of approximately 90 degrees with respect to one another, wherein the plug side has at least one lock for locking the plug connector to a mating plug connector, wherein the electrical contact is bent at a right angle and is rotatably arranged in one of the insulating body parts, the one insulating body part with the electrical contact received therein is inserted into the plug side or the assembly side of the plug connector housing by a rotational movement, and the further insulating body part is inserted into the assembly side or the plug side of the plug connector housing, wherein the first contact side and the second contact side project out of the plug connector housing, at least in some regions, and wherein the two insulating body parts latch to one another in the plug connector housing.

* * * * *